United States Patent [19]

Shirase et al.

[11] 4,434,776

[45] Mar. 6, 1984

[54] EGR CONTROL SYSTEM

[75] Inventors: Haruya Shirase, Kawasaki; Takehisa Kondo, Kanagawa, both of Japan

[73] Assignee: Nissan Motor Co., Ltd., Yokohama, Japan

[21] Appl. No.: 244,344

[22] Filed: Mar. 17, 1981

[30] Foreign Application Priority Data

Mar. 18, 1980 [JP] Japan ..... 55-35526[U]

[51] Int. Cl.[3] ..... F02M 25/06

[52] U.S. Cl. ..... 123/568

[58] Field of Search ..... 123/568

[56] References Cited

U.S. PATENT DOCUMENTS

| | | | |
|---|---|---|---|
| 4,069,797 | 1/1978 | Nohira et al. | 123/568 |
| 4,092,960 | 6/1978 | Nohira et al. | 123/568 |
| 4,130,093 | 12/1978 | Aoyama | 123/568 |
| 4,148,286 | 4/1979 | Kohama et al. | 123/568 |
| 4,180,033 | 12/1979 | Aoyama | 123/568 |
| 4,180,035 | 12/1979 | Saiki et al. | 123/568 |
| 4,248,186 | 2/1981 | Yamada | 123/568 |
| 4,282,847 | 8/1981 | Ikuta et al. | 123/568 |

*Primary Examiner*—Wendell E. Burns

*Attorney, Agent, or Firm*—Thompson, Birch, Gauthier & Samuels

[57] ABSTRACT

An EGR system has two vacuum modulation valves, one responsive to venturi vacuum and "EGR" pressure (which prevails just upstream of the EGR flow control valve) and the other responsive to venturi vacuum and induction vacuum. The first valve predominately dilutes the vacuum operating the EGR flow control valve during heavy load operation while the second valve predominately dilutes said vacuum during light load and/or high speed operation. With this combination, excessive EGR is avoided during said light load and high speed operations, respectively.

4 Claims, 4 Drawing Figures

EGR CONTROL SYSTEM

BACKGROUND OF THE INVENTION

1. Field of the Invention

The present invention relates generally to an EGR system and more particularly to a control system which can appropriately meter the flow of exhaust gas to the engine at relatively high rates during heavy load operation and which appropriately reduces the supply at low load operation and/or high engine speed operation.

2. Description of the Prior Art

A known arrangement is depicted in FIG. 1 of the drawings, and is fully described in U.S. Pat. No. 4,130,093, issued Dec. 19, 1978. In that system, exhaust gas is recirculated from an exhaust conduit 1 via an EGR passage 2 to an induction manifold 3. An EGR flow control valve 4 is disposed in the passage 2 as shown, for regulating the flow through the passage. This valve includes a vacuum motor 5 which fluidly communicates with a source of induction vacuum. To control the amount of exhaust gas recirculation, a single control or correction valve (a so called VVT valve) 6 is supplied with pressure signals originating at a venturi portion 7 of the induction manifold 3 and a zone defined in the EGR passage upstream of the flow control valve 4 and downstream of a flow restriction 8.

However, this arrangement, when set to recirculate relatively large amounts of exhaust gas during high load operation when relatively large amounts of NOx are formed, has suffered from the drawback that excessive amounts of exhaust gas are recirculated at low load and/or high engine speed operation. This is of course undesirable, as the NOx formation under these conditions is relatively low, thus requiring only a low rate of EGR. Further, the excessive recirculation under such conditions leads to poor fuel economy and poor drivability.

SUMMARY OF THE INVENTION

The present invention features an EGR system having an EGR flow control valve which is fed a vacuum modulated by two independent modulation valves, one of which is responsive to venturi vacuum and a pressure signal which originates upstream of the ERG flow control valve and downstream of a flow restriction in the EGR passage, while the other valve is responsive to induction vacuum and venturi vacuum. With this system, since the second vacuum modulation valve is responsive to the venturi and induction vacuum, and the pressure differential therebetween increases during low load operation but rapidly decreases during intermediate load operation, the second valve tends to predominately control the vacuum modulation (or dilution) during low load operation, whereas the first valve predominately controls said modulation during heavy or high load operation.

It is therefore an object of the present invention to provide an EGR system which is simple but will avoid supplying excessive amounts of exhaust gas under light load and high speed operation but will recirculate relatively large amounts of exhaust gas during heavy load operation.

BRIEF DESCRIPTION OF THE DRAWINGS

The features and advantages of the arrangement of the present invention will become more clearly appreciated from the following description taken in conjunction with the accompanying drawings in which.

DETAILED DESCRIPTION OF THE PREFERRED EMBODIMENTS

Figure 1:
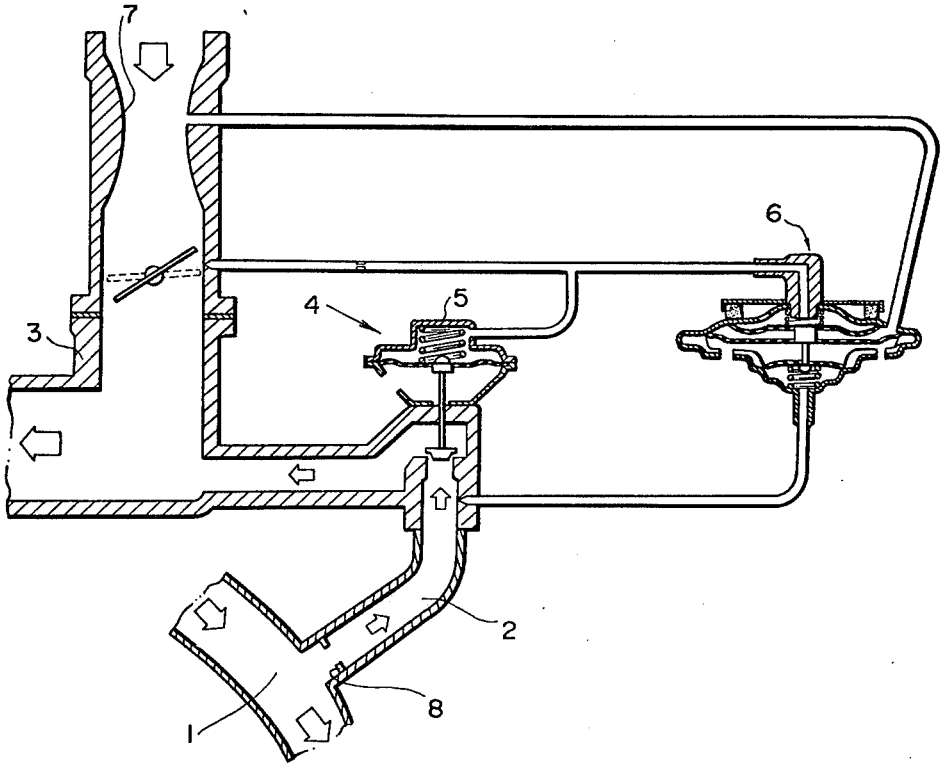
FIG. 1 (PRIOR ART)
FIG. 1 is a schematic drawing showing the prior art arrangement discussed briefly under the heading "Description of the Prior Art"
Figure 2:
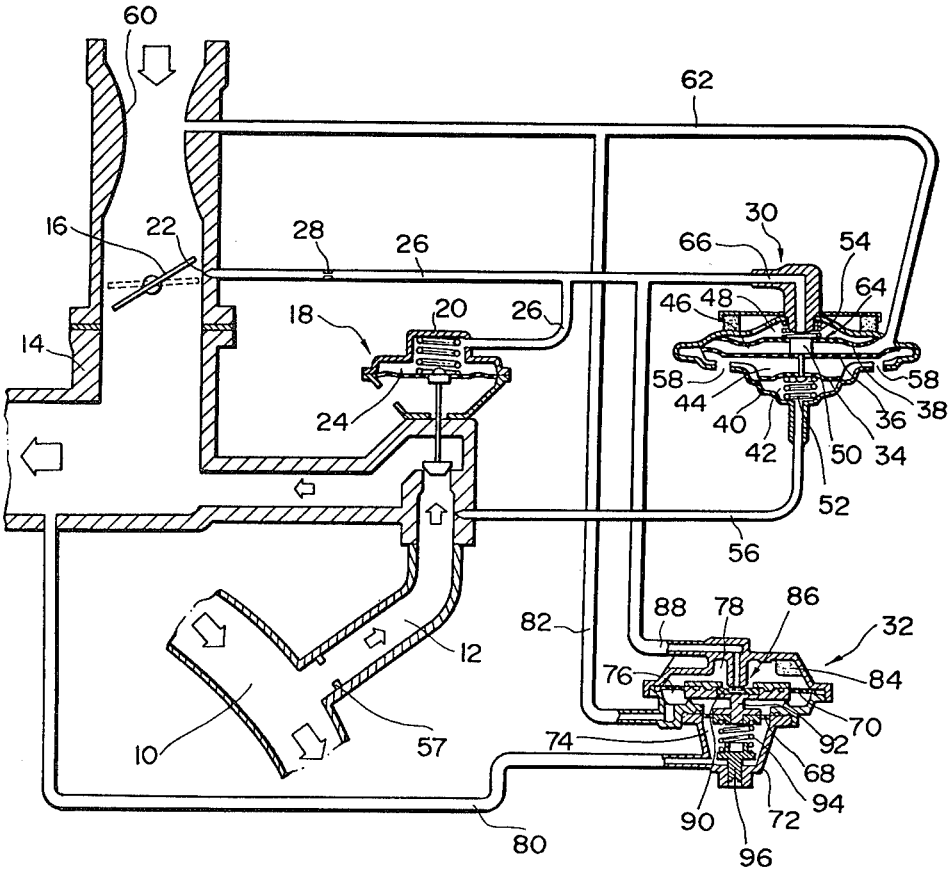
FIG. 2 is a schematic drawing showing a preferred embodiment of the present invention.

Turning now to the drawings and more specifically to FIG. 2, a preferred embodiment of the present invention is shown. In this arrangement, exhaust gas is recirculated from an exhaust conduit 10 via an EGR (exhaust gas recirculation) passage or conduit 12 to an induction manifold 14 at a point downstream of the throttle valve 16 operatively disposed therein. An EGR flow control valve 18 is disposed in the EGR passage for controlling the flow of exhaust gas therethrough. This valve includes a vacuum motor 20 in fluid communication with a source of induction vacuum. In this case, the source of vacuum originates at a TV (throttle valve) port 22 controlled by the throttle valve 16.

As shown in broken line, when the throttle valve is fully closed, the TV port 22 is exposed to atmospheric pressure. However, upon the throttle valve's opening a few degrees, said port is exposed to a relatively high induction vacuum. Thus, when the engine is idling, little or no vacuum is fed to the vacuum chamber 24 of the vacuum motor 20 via the conduit 26. To smooth the supply of vacuum, a flow restrictor 28 is disposed in the conduit between the TV port and the vacuum chamber.

To control the level of vacuum in the vacuum chamber 24, first and second vacuum modulating valves 30 and 32 are provided. The first of these modulating valves is provided with first, second and third diaphragms 34, 36, 38 which divide the housing 40 of the valve into first, second, third and fourth variable volume pressure chambers 42, 44, 46, 48. The three diaphragms 34, 36 and 38 are interconnected by a connection member 50 for synchronous movement. Springs 52 and 54 are disposed respectively in the first and fourth pressure chambers for biasing the diaphragm system to a predetermined position. The first pressure chamber 42 fluidly communicates through a conduit 56 with a zone defined in the EGR passage between the EGR flow control valve 18 and a flow restriction 57 so as to be exposed to a back pressure which shall be referred to hereinafter as EGR pressure. The second pressure chamber 44 freely communicates with the atmosphere through atmospheric ports 58. The third pressure chamber 46 fluidly communicates with a venturi portion 60 through a conduit 62. The fourth pressure chamber 48 communicates with the atmosphere.

An air bleed valve 64 is defined in the fourth pressure chamber 48. This valve takes the form of a conduit 66 which projects into the housing and which is closable upon the diaphragm system's (diaphragms 34, 36, 38) flexing upwardly (as seen in the drawings). To provide an adequate seal under these conditions, a valve seat (not illustrated) may be provided on the third diaphragm 38. The conduit 66 is extended to communicate with the conduit 26 at a point between the vacuum chamber 24 and the flow restrictor 28.

Figure 3:
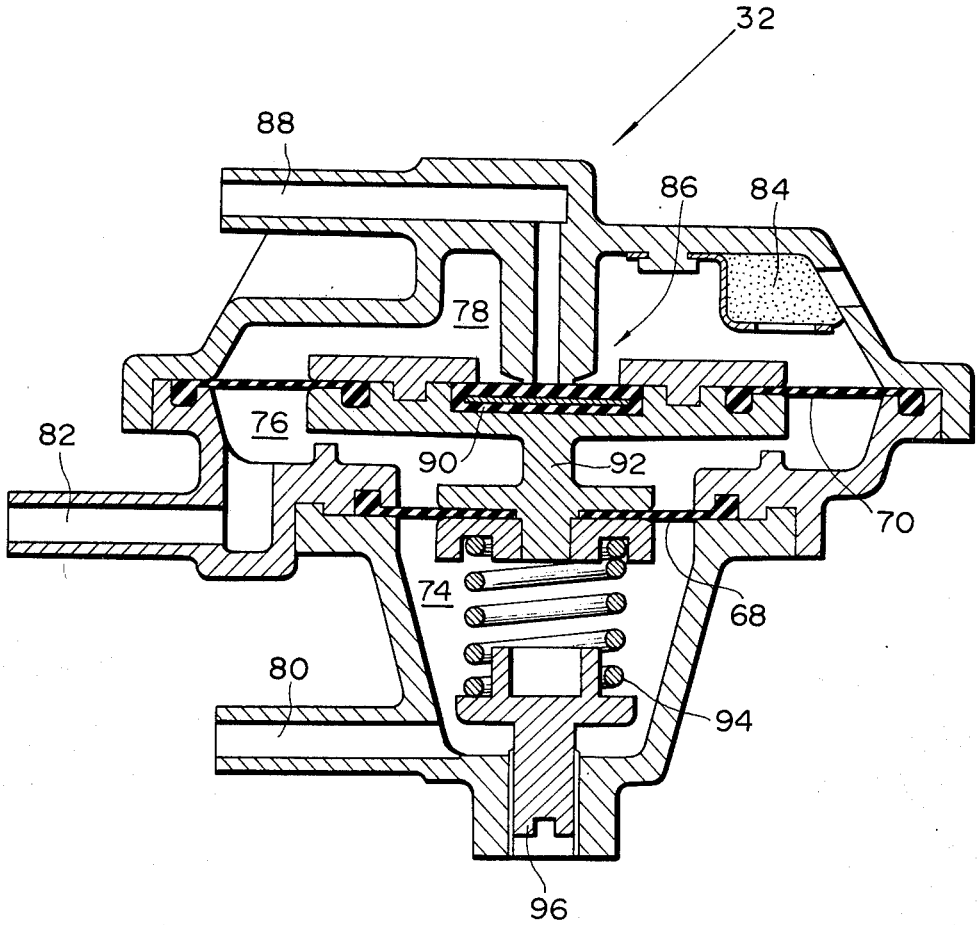
FIG. 3 is an enlarged sectional view of the second vacuum modulation valve which characterizes the present invention.

As best shown in FIG. 3, the second of the vacuum modulating valves 32 is provided with fourth and fifth diaphragms 68 and 70 which divide the housing 72 thereof into fifth, sixth, and seventh variable volume pressure chambers 74, 76, 78. The fifth pressure chamber 74 communicates with the induction manifold 14 through a conduit 80. This conduit communicates with the induction manifold at a point downstream of the throttle valve. The sixth pressure chamber 76 fluidly communicates with the venturi portion 60 through a conduit 82 which fluidly communicates with the conduit 62. The seventh pressure chamber 78 fluidly communicates with the atmosphere through an air cleaner 84, and contains an air bleed valve 86 in the form of a conduit 88 and a valve seat 90. The conduit 88 is closable upon the upward flexing (as seen in the drawings) of diaphragms 68, 70 which are interconnected for synchronous movement by a connection member 92. A spring 94 is disposed in the first pressure chamber 74 and is seated on an adjusting member 96 threadedly mounted in the housing 72.

During operation, when the engine is idling, and the throttle valve 16 is closed as shown in broken line, no vacuum is fed to the vacuum chamber 24 of the vacuum motor 20 due to the exposure of the TV port 22 to the substantially atmospheric pressure above the throttle valve blade. Hence, the EGR flow control valve 18 is closed and no exhaust gas is recirculated, thus promoting stable idling. As the throttle valve is opened a few degrees to, for example, the position shown in solid line in FIG. 2, the substantial vacuum prevailing downstream of the throttle valve is exposed to the TV port 22 and is accordingly transmitted to the vacuum chamber 24 of the vacuum motor. Simultaneously, the air flow through the venturi portion increases, producing a venturi vacuum which is fed to third pressure chamber 46 of the first vacuum modulation valve 30 and to sixth pressure chamber 76 of the second vacuum modulation valve 32. With the increased amount of air induction, the EGR pressure accordingly rises, and this pressure is fed to the first pressure chamber 42 of the valve 30. As the effective surface area of the first vacuum modulation valve second diaphragm 36 is greater than that of the third diaphragm 38, a resultant force produced by the pressure differentials between the venturi vacuum in third pressure chamber 46 and atmospheric across respective second and third diaphragms tends to move the diaphragm system against the bias of spring 54 to close the air bleed valve 64. The EGR pressure introduced into the first pressure chamber 42 also tends to move the diaphragm system against the bias of the spring 54. Under these conditions the amount of air bled into the conduit 66 to modulate the vacuum prevailing in the vacuum chamber 24 is relatively small, and therefore tends to allow an excessively high vacuum to prevail in the vacuum chamber 24. This modulation alone would of course tend to open the EGR flow control valve excessively. However, simultaneously the venturi vacuum is fed to the sixth pressure chamber 76 of the second vacuum modulation valve 32, while the induction vacuum is fed to the fifth pressure chamber 74 thereof. Under these conditions, both of the diaphragms 68 and 70 will tend to flex downward against the bias of the spring 94, to open the air bleed valve 86 and, accordingly, bleed off some of the otherwise excessive vacuum in the vacuum chamber 24. Accordingly, with the combined operations of the two vacuum modulation valves, an appropriate vacuum will prevail in the vacuum chamber 24 and, accordingly an appropriate amount of exhaust gas is recirculated.

As the load on the engine increases, the venturi vacuum tends to increase in proportion thereto, while the induction vacuum downstream of the throttle valve tends to decrease proportionally. Further, the magnitude of the pressure differential between the venturi and the induction vacuums tends to increase during low load operation but rapidly decreases during intermediate range.

Thus, during low load operation, due to the relatively small opening degree of the throttle valve, a relatively high vacuum prevails in the induction manifold 14, while at the same time a relatively low vacuum prevails in the venturi due to the small amount of air being inducted into the engine. Under these conditions, the high pressure differential across the interconnected diaphragms 68 and 70, more specifically, the pressure differential between pressure chambers 74 and 78, drives the diaphragm system (68 and 70) downwardly against the bias of spring 94 to open the air bleed valve 86 and to introduce a suitable amount of air into the conduit 88 to bleed off some of the otherwise excessive vacuum in the vacuum chamber 24. Accordingly, during this mode of operation the second valve 32 predominately controls the modulation of the vacuum in the vacuum chamber 24, and thus the operation of the EGR flow control valve 18.

However, as the throttle valve is further opened and the engine enters intermediate load operation, the vacuum in the induction manifold is reduced so that the aforementioned pressure differential between the chambers 74 and 78 rapidly decreases, allowing the diaphragms 68, 70 to rise under the bias of the spring 94, thereby reducing the amount of air allowed to enter the conduit 88 through the second air bleed valve 86. At the same time, the venturi vacuum fed to the pressure chamber 76 tends to increase and move the diaphragms 68, 70, due to the difference in effective surface areas thereof, downwardly against the spring 94 to slightly offset the tendency of the second air bleed valve 86 to close completely. Therefore, the air flow through the second air bleed valve 86 is restricted to the point that the vacuum modulation during intermediate load operation is predominately controlled by the first vacuum modulation valve 30.

During high speed operation, when a relatively high venturi vacuum is fed to the vacuum modulation valves and a low induction vacuum (the throttle valve's being opened a substantial degree) is fed to the fifth pressure chamber 74 of the second vacuum modulation valve 32, the first air bleed valve 64 will tend to close (which in the prior art induces excessive exhaust recirculation). At the same time, the increased venturi vacuum increases the pressure differentials across the modulating valve diaphragms 68 and 70. The effective surface area of the diaphragm 70 being larger than that of diaphragm 68 results in a force differential which urges the interconnected diaphragms downwardly to open the second air bleed valve 86. Hence, under these conditions also, the vacuum modulation function of the second vacuum modulation valve 32 predominates, and the otherwise excessive vacuum in vacuum chamber 24 is appropriately reduced.

Figure 4:
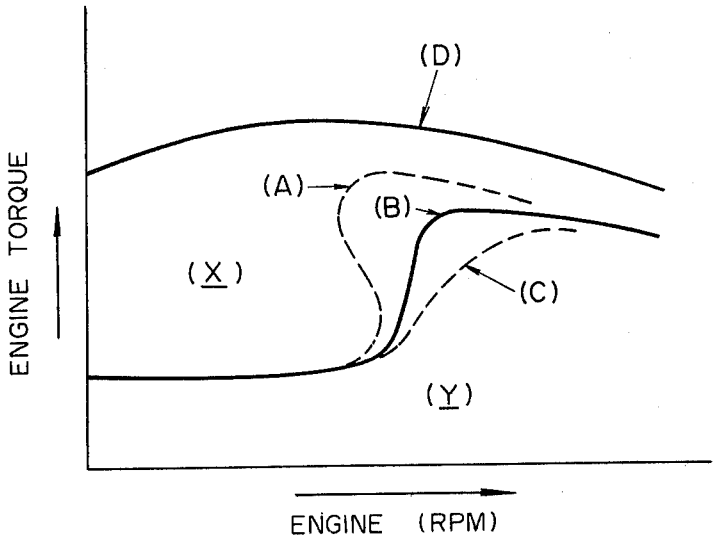
FIG. 4 is a graph in terms of engine output torque and RPM showing the operational characteristics of the arrangement shown in FIG. 2.

FIG. 4 is a graph showing the engine output characteristics when provided with an EGR control system as set forth hereinbefore. In this graph, the engine output characteristics are shown in terms of engine torque and RPM. The solid line trace (D) shows the torque variation with the throttle valve wide open. The domain (X) defined between the trace (D) and any one of traces (A), (B) and (C) indicates an operational zone wherein the EGR is controlled by a so-called "VVT" (Venturi Vacuum Transducer) system, while the domain defined below any one of the traces (A), (B) and (C) indicates a zone in which the EGR is controlled by a so-called "BPT" (Back Pressure Transducer) system. By selecting the effective areas of the diaphragms 68 and 70, the ratio $S_1/S_2$, where $S_1$ is the effective area of the diaphragm 70 and $S_2$ is the effective area of the diaphragm 68, can be adjusted. By selecting $S_1/S_2$ to have a relatively large value, the boundary between the "VVT" and "BPT" system control is defined by trace (A), while as the value of $S_1/S_2$ is reduced, the boundary shifts in the direction of traces (B) and (C).

What is claimed is:

1. In an internal combustion engine having an exhaust conduit and an induction manifold including a venturi portion, the combination of:

an EGR conduit fluidly interconnecting said exhaust conduit and said induction manifold;

an EGR flow control valve disposed in said EGR conduit for controlling the flow of exhaust gas therethrough, said EGR flow control valve having a vacuum motor including a vacuum chamber, said vacuum chamber being fluidly communicated with a source of vacuum;

a first vacuum modulation valve for modulating the vacuum prevailing in said vacuum chamber, said first vacuum modulation valve being responsive to a venturi vacuum signal which originates in said venturi portion and a pressure signal which originates in a zone of said EGR conduit upstream of said EGR flow control valve and downstream of a flow restriction disposed in said EGR conduit; and a second vacuum modulation valve for modulating the vacuum prevailing in said vacuum chamber, said second vacuum modulation valve being responsive to said venturi vacuum signal and an induction vacuum prevailing in said induction manifold.

2. A combination as claimed in claim 1, wherein said first vacuum modulation valve comprises:

a housing having first, second and third interconnected diaphragms disposed therein which divide said housing into first, second, third and fourth variable volume pressure chambers, said first chamber being fluidly communicated with said zone in said EGR conduit, said second chamber being fluidly communicated with the atmosphere, said third chamber being fluidly communicated with said venturi portion for receiving said venturi vacuum, and said fourth chamber being fluidly communicated with the atmosphere and having a first conduit which extends toward said third diaphragm, said first conduit and said third diaphragm defining a first air bleed valve which controls the amount of air admitted to said vacuum chamber to modulate the vacuum therein.

3. A combination as claimed in claim 1, wherein said second vacuum modulation valve comprises:

a housing containing therein fourth and fifth interconnected diaphragms which divide said housing into fifth, sixth and seventh variable volume pressure chambers, said fifth pressure chamber being fluidly communicated with said induction manifold for receiving said induction pressure, said sixth chamber being fluidly communicated with said venturi portion for receiving said venturi vacuum signal, and said seventh chamber being fluidly communicated with the atmosphere and provided with a second conduit which extends toward said fifth diaphragm, said second conduit and said fifth diaphragm defining a second air bleed valve for controlling the amount of air admitted to said vacuum chamber for modulating the vacuum prevailing therein.

4. A combination as claimed in claim 1, further comprising a throttle valve operatively disposed in said induction manifold, and wherein said source of vacuum takes the form of induction vacuum which is tapped off at a port located in said induction manifold immediately upstream of said throttle valve when in the fully closed position, said port being exposed to the induction vacuum when said throttle valve is opened from its closed position.

* * * * *